United States Patent [19]

Kremser et al.

[11] Patent Number: 4,520,548

[45] Date of Patent: Jun. 4, 1985

[54] METHOD AND APPARATUS FOR FASTENING AN ERASER TO A PENCIL

[75] Inventors: Harald H. Kremser, Postbauer-Heng; Walter Barth, Nüremberg, both of Fed. Rep. of Germany

[73] Assignee: Bleistiftmaschinenfabrik Dipl. Ing. Karl Zuber GmbH & Co. KG, Nüremberg, Fed. Rep. of Germany

[21] Appl. No.: 445,524

[22] Filed: Nov. 30, 1982

[30] Foreign Application Priority Data

Dec. 3, 1981 [DE] Fed. Rep. of Germany ..... 3147863

[51] Int. Cl.[3] ..... B21D 39/00

[52] U.S. Cl. ..... 29/517; 29/509; 29/511

[58] Field of Search ..... 29/428, 505, 509, 510, 29/511, 515, 785, 787; 198/459, 453, 454; 100/153

[56] References Cited

U.S. PATENT DOCUMENTS 2,405,367 8/1946 Nichols ..... 144/28

2,975,822 3/1961 Gent et al. ..... 29/520

4,427,492 1/1984 Cronin ..... 100/153

*Primary Examiner*—Howard N. Goldberg

*Assistant Examiner*—Steven Nichols

*Attorney, Agent, or Firm*—Browdy and Neimark

[57] ABSTRACT

A method and apparatus for securing an eraser to a pencil while deforming a sheath mounted at one end on one end of the pencil and on the other end partially receiving the eraser, the sheath being subjected to deforming forces directed on the one hand toward the pencil and on the other toward the eraser. In order to provide a fastening of the sheath to the pencil and to the eraser, the pencil is guided along a path while at least the sheath is rolling, and the sheath is subjected to the deforming forces at least intermittently while rolling. The apparatus for performing the method comprises a pressure gap decreasing height between two parts that are movable relative to one another. The pressure gap is larger at the inlet and smaller toward the outlet than the outer diameter of the sheath in its underformed state.

11 Claims, 3 Drawing Figures

METHOD AND APPARATUS FOR FASTENING AN ERASER TO A PENCIL

FIELD OF THE INVENTION

The invention relates to a method for fastening an eraser to a pencil and to an apparatus for performing the method, in which a sheath mounted at one end on one end of the pencil and at the other end partially receiving the eraser is subjected to deforming forces exerted against the portions of the sheath surrounding both the pencil and the eraser.

BACKGROUND OF THE INVENTION

Fastening approximately cylindrical erasers to one end of a pencil by means of a relatively thin-walled metal sheath, generally called a capsule, has been known for many decades. The sheath is mounted onto one end of the pencil, the pencil usually having been somewhat compressed beforehand in this area, so that the sheath is already held somewhat in place on the pencil, although not firmly. A cylindrical eraser is then inserted into the open end of the sheath. This manner of preassembling the pencil, sheath and eraser is presumed in the context of the present invention and will not be altered. The sheath is then deformed relative to the pencil on the one hand and the eraser on the other. To this end, tongs having a plurality of tips engage the sheath in the vicinity of the pencil and press inward on the sheath at a plurality of points, causing it to mesh with the pencil. In the same manner, the sheath is deformed by means of the tongs in the vicinity of the eraser, so that again a connection is established between the sheath and the eraser. This mode of operation can only take place in increments, because the pencils are moved individually toward the tongs. The sheath is deformed while the pencils are at a standstill. Such an operation is expensive in terms of machinery and does not permit high-speed operation.

SUMMARY OF THE INVENTION

It is accordingly the object of the invention to disclose a method of the general type discussed above by means of which a continuous fastening of the sheath to the pencil and to the eraser is possible, and to disclose an apparatus for performing the method.

This object is attained in accordance with the invention, in a method of the general type discussed above, by guiding the pencil along a path while at least the sheath is rolling and subjecting the sheath at least intermittently to the forces of deformation while it is rolling. In other words, the essence of the invention is that the sheath is simultaneously reduced in its diameter both in the vicinity of the pencil and in the vicinity of the eraser while it is rolling and being subjected to deformation forces during this rolling. The sheath is pressed against both the pencil and the eraser as a result. This method is completely continuous, although it is entirely possible to make this rolling movement intermittent. The method according to the invention has the advantage that the sheath or capsule is subjected to substantially continual deformation while rolling, so that the deformation forces can be made effective for the majority of the rolling period at least; uniform deformation, on the one hand, and a simultaneous reduction in processing time on the other are thereby attained. It is not necessary to use glue.

In the apparatus for performing the method according to the invention, there is a pressure gap of decreasing height between two parts movable relative to one another; at the inlet, the gap is larger than the outer diameter of the undeformed sheath and at the outlet, the gap is smaller. A simple relative movement of two parts toward one another attains a slip-free rolling movement on the part of the pencil with the capsule, so that the appropriate pressure is exerted as a result of the constriction of the pressure gap.

According to a further provision of the invention, the height of the pressure gap increases again toward the outlet, following a point of minimum height; the pencil is therefore ejected not directly following the point of maximum deformation force but rather after a relief of pressure.

Because the elements are adjustable relative to one another, the course of the pressure gap can be fixed precisely, and in particular adaptation to various sheath diameters or sheath materials is attainable.

The invention further provides that at least one of the faces defining the pressure gap is especially contoured for deformation, so that the sheaths need not be deformed over their entire length, which would be relatively expensive, but only specifically in certain areas. This is attained in particular with profiled edges, enabling continuous deformations in the form of grooves or the like in the sheath; knurling or the like is equally possible, however.

Although it is possible in principle to embody the pressure gap as straight, embodying the pressure gap in the form of a profiled rolling wheel and a pressure chuck is particularly advantageous, because this provision makes it possible in a particularly simple manner to effect not only continuous but also intermittent operation. This embodiment is also particularly simple in terms of production engineering. A particularly easy introduction of the pencils, already provided with sheaths or capsules and erasers, into the pressure gap is enabled particularly simply by means of a substantially cylindrical transporter for the pencils which has axially parallel devices for holding and guiding them on its circumference.

Practically slip-free rolling of the sheaths or capsules with the pencils within the pressure gap is enabled by providing that the profiled rolling wheel can be driven at approximately twice the speed of the transporter.

Although the pressure face on the pressure chuck need be embodied merely such that the required course of the pressure gap is created, it is particularly efficacious and also particularly simple in terms of engineering if the pressure face has the cross section of an arc of a circle, and the center axis of the pressure face is disposed slightly eccentrically to the axis of the profiled rolling wheel.

The axial position of the pencils can be fixed in a simple manner by providing a guide-stop in the area of the pencils remote from the sheaths.

Further advantages and characteristics of the invention will become apparent from the ensuing description of an exemplary embodiment, taken in conjunction with the drawing.

DESCRIPTION OF THE PREFERRED EMBODIMENT

Figure 1:
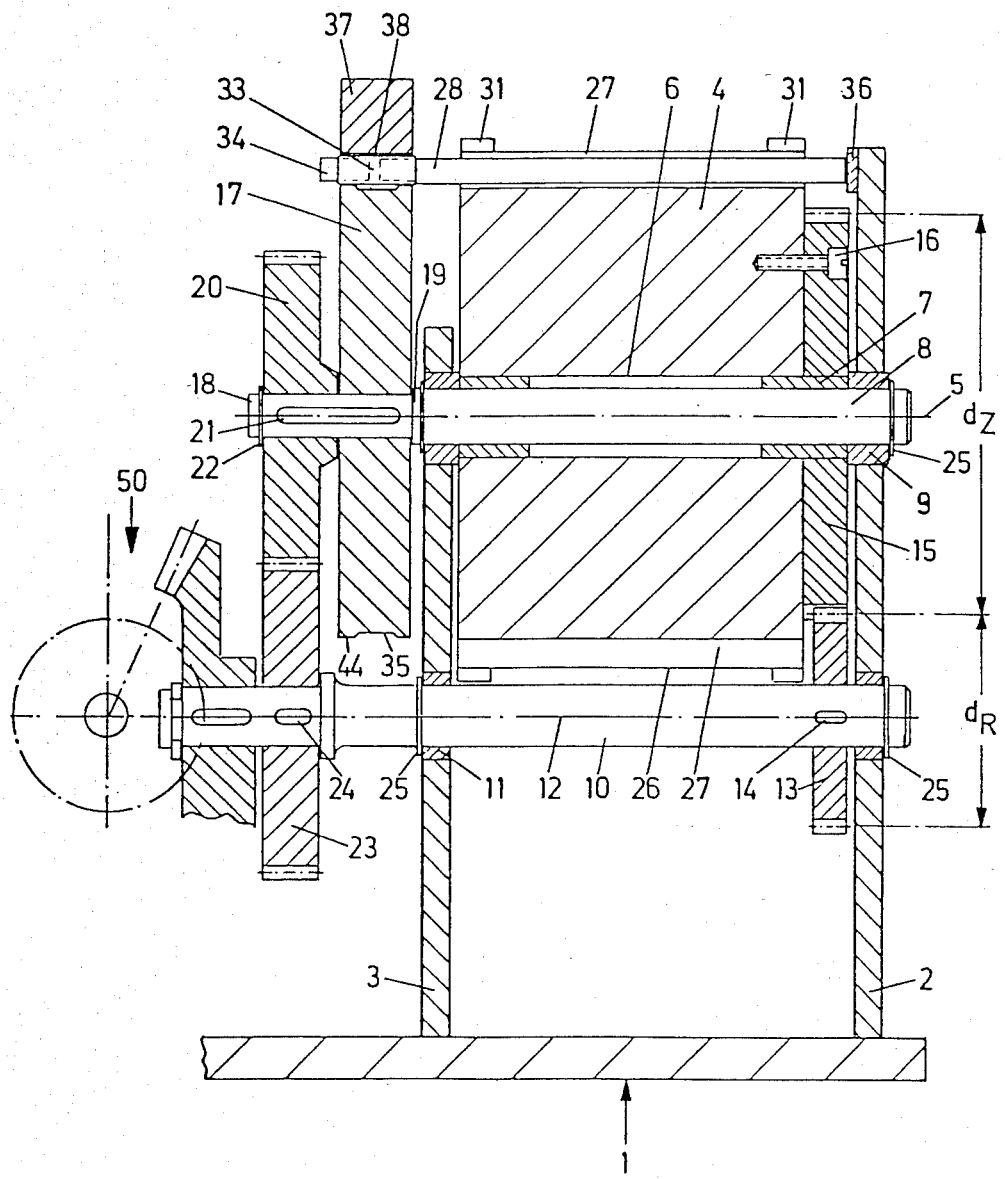
FIG. 1 is a cross section taken through an apparatus according to the invention.

The apparatus shown in the drawing has a frame 1, which is provided with two supporting walls 2, 3 that are parallel to one another. A cylindrical transporter 4 is supported by and lies between these supporting walls. The transporter 4 has a bore 6 extending concentrically to its center axis 5, and two bearings 7 embodied as slide bearings are disposed at the outer ends of the bore. The bearings 7 are supported rotatably on a shaft 8 which is likewise disposed concentrically to the axis 5. The shaft 8 is supported in turn such that it is freely rotatable in corresponding bearings 9 in the supporting walls 2, 3 of the frame 1

A countershaft 10 is also supported in a freely rotatable manner in the supporting walls 2, 3 by means of corresponding bearings 11, the axis 12 of which extends parallel to the axis 5. A pinion 13 is secured on this countershaft 10 axially beside the transporter 4 in the vicinity of one supporting wall 2 and is prevented from rotating relative to countershaft 10 by means of a feather connection 14; the pinion 13 engages a gear wheel 15 that is connected in a rotationally fixed manner to the transporter 4. To this end, the 9ear wheel 15 is secured by means of screws 16 to the end face of the transporter 4 that is oriented toward the latter supporting wall 2. As may be seen from the drawing, the diameter $d_R$ of the pinion 13 is clearly smaller than the diameter $d_Z$ of the gear wheel 15; thus when the transporter 4 is driven from the direction of the countershaft 10, the rpm $n_z$ is clearly less than the rpm $n_R$ of the countershaft 10. The reduction ratio may be expressed as $n_R:n_Z=d_Z:d_R=2:1$.

Also driven by the countershaft 10 is a profiled rolling wheel 17, which is attached to a shaft tang 18 of the shaft 8 protruding beyond the supporting wall 3. Toward the supporting wall 3, the profiled rolling wheel 17 rests axially against a collar 19 on the shaft 8 between that shaft and the shaft tang 18. A gear wheel 20 presses from the outside against the profiled rolling wheel 17 and is likewise attached in a rotationally fixed manner to the shaft tang 18. The profiled rolling wheel 17 and the gear wheel 20 are fixed such that they cannot rotate relative to the shaft 8 by means of a common feather connection 21. The gear wheel 20 is secured against axial movements downward from the shaft tang 18 by a fastening ring 22, which simultaneously also fixes the profiled rolling wheel 17 axially. A drive pinion 23 which is likewise fixed on the countershaft 10 in a rotationally fixed manner by means of a feather connection 24 engages the gear wheel 20. As may be seen from the drawing, the diameters of the gear wheel 20 and the drive pinion 23 are approximately equal, producing a translation or reduction ratio of approximately 1:1; in other words, the profiled rolling wheel 17 rotates at approximately the same speed as the countershaft 10.

The shaft 8 and the countershaft 10 are naturally fixed axially in the supporting walls 2, 3 within their respective bearings 9 and 11, as is indicated in the drawing by fastening rings 25.

Reception grooves 27 for pencils 28 are embodied parallel to the axis 5 in the cylindrical circumferential face 26 of the transporter 4, and the pencils 28 are delivered via a delivery chute 29 from a magazine, not shown, or—preferably—from a preceding processing machine 30. To assure satisfactory transfer of the pencils 28 from the delivery chute 29 into the grooves 27, radially protruding carriers 31 are disposed in the vicinity of the ends of each groove 27, at the rear side or trailing edge of the groove as viewed in the direction of rotation 32. The delivery chute 29 discharges approximately radially onto the transporter 4, somewhat above the horizontal. The processing machine 30 is a machine in which approximately cylindrical sheaths, so-called capsules 33, are pushed onto one end of a given pencil 28 to approximately half the length of the sheath . A cylindrical eraser 34 is then inserted into the end of the sheath 33 that protrudes freely from the pencil 28. In this form, with the sheath 33 still only relatively loosely in place and with the eraser 34 loosely inserted, the pencils 28 are transferred via the delivery chute 29 into the grooves 27 of the transporter 4. The pencils 28 are guided during this transfer in the direction of rotation 32 such that the sheathes 33 axially overlap the circumferential face 35 of the profiled rolling wheel 17. In order to assure this manner of axial position of the pencils 28, which as a group are all of equal length, the pencils rest with their end remote from the sheath 33 against a guide stop 36, which is provided in the vicinity of the supporting wall 2 remote from the profiled rolling wheel 17. The stop 36 may by way of example be connected directly to this supporting wall 2.

A pressure chuck 37 is associated with the profiled rolling wheel 17 over a portion of its circumferential face 35, and the pressure face 38 of the pressure chuck 37 oriented toward the circumferential face 35 of the profiled rolling wheel 17 has a decreasing radial spacing from the circumferential face 35 when viewed in the direction of rotation 32; in the vicinity of the end, this spacing may increase once again. The pressure face 38 is embodied as a segment of a cylinder for the sake of simplicity; that is, its cross section is that of a circular arc section. In order to attain the described course of the spacing between the pressure face 38 and the circumferential face 35, the center point or the center axis 39 of the pressure face 38 is disposed with an eccentricity e of a few tenths of a millimeter from the axis 5, but parallel to it. The two axes 5 and 39 are located in a common plane 40, which intersects the pressure face 38 in its rear portion as viewed in the direction of rotation 32. At this point, the pressure gap 41 between the pressure face 38 and the circumferential face 35 has its smallest radial height $a_{min}$. The pressure gap 41 is at its maximum radial height $a_{max}$ at its inlet 42, that is, at the point where when transfer is effected in the direction of rotation 32 the sheathes 33 of the pencils 28 are introduced into the pressure gap 41. For the pressure angle $\alpha$ between the inlet 42 and the plane 40 in the direction of rotation 32, $\alpha \overline{<} 180°$, if—as is assumed in this exemplary embodiment, the pressure face 38 has a circular cross section. If the pressure face 38 is embodied in the manner of a spiral, then naturally the angle $\alpha$ may also be larger than 180°. Under practical conditions, it is sufficient for the pressure angle $\alpha$ to amount to from 60° to 90°. The pressure face 38 extends farther beyond the plane 40 by the amount of a relief angle $\beta$ of from 30° to 50°. In this vicinity, the pressure gap 41 widens in the radial direction from the plane 40 toward the outlet 43. The radial height $a_{aus}$ at the outlet 43 is larger than $a_{min}$.

Figure 2:
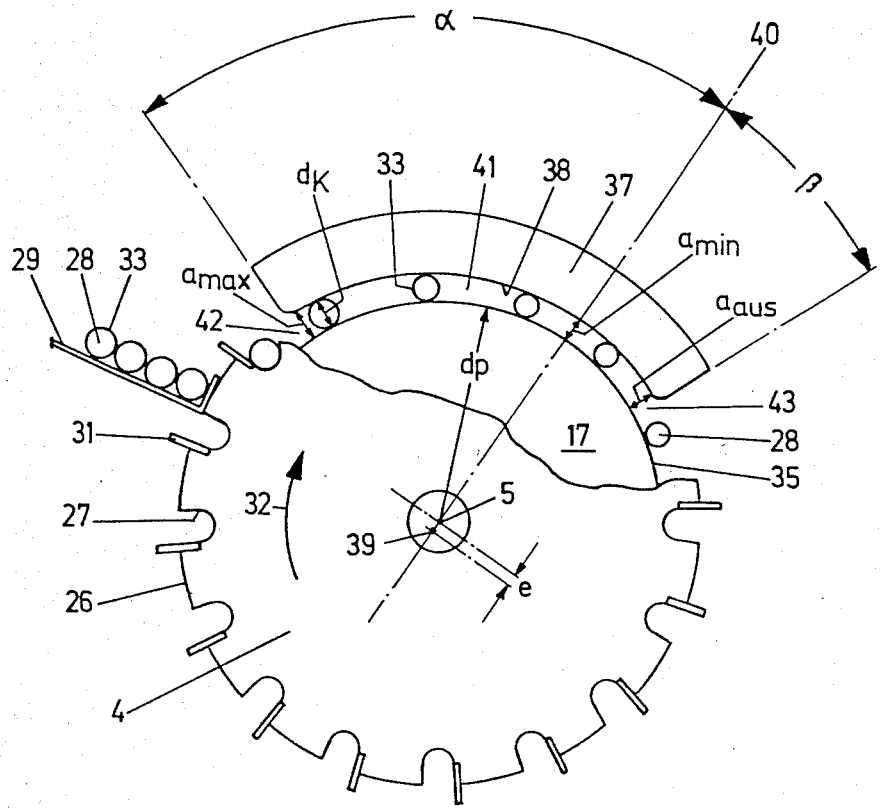
FIG. 2 shows a partial side view of the apparatus, seen partially cut away.
Figure 3:
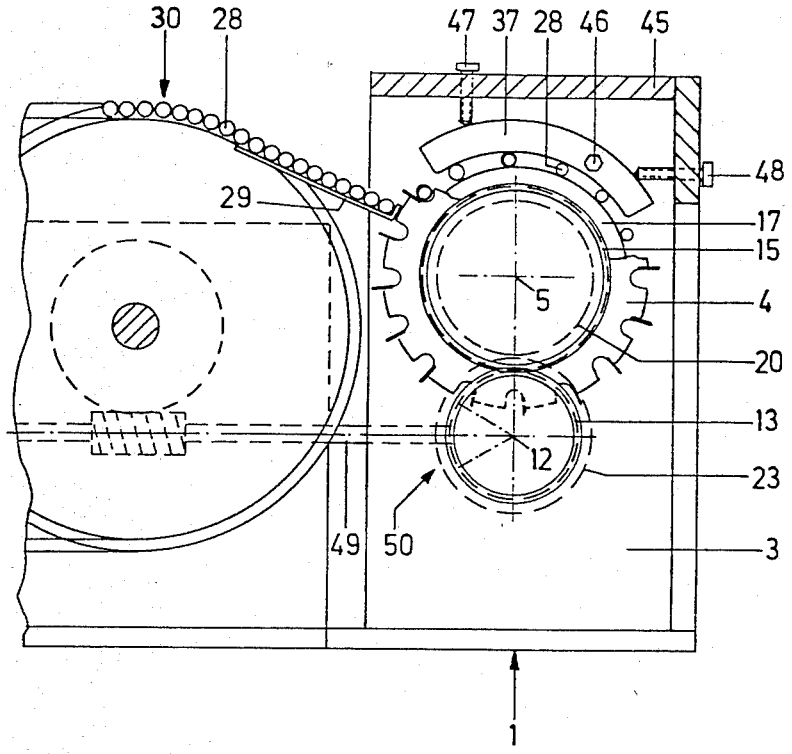
FIG. 3 shows a partial side view of the apparatus where it is connected to a processing machine which precedes it.

As is shown particularly in FIG. 2 the pencils are guided by means of the transporter 4 in such a manner that the sheaths 33 enter the pressure gap 41 substantially over their entire axial length, or in any case still with a portion of the end of a given pencil 28 engaged by the sheath 33. For the outer diameter $d_K$ of the sheath 33 before their entry into the pressure gap 41, $a_{max} > d_k > a_{min}$; $d_k$ is only just enough smaller than $a_{max}$ that the given sheath 33 comes to rest against the pressure face 38 and the circumferential face 35 directly following the inlet 42 into the pressure gap 41. Since the pressure chuck 37 and thus the pressure face 38 as well are stationary, and since the profiled rolling wheel 17 revolves at approximately twice the speed of the transporter 4, the sheathes 33 roll off in a slip-free manner on the pressure face 38. They accordingly move at the circumferential speed of the transporter 4 through the pressure gap 41, and they advance with their jacket lines resting on the circumferential face 35 in accordance with the approximately twice as fast circumferential speed of the circumferential face 35, with the result that slip-free rolling takes place on the circumferential face 35 as well. Since the diameter $d_p$ of the profiled rolling wheel 17, at 150 to 250 mm, is substantially greater than the diameter $d_K$, which is approximately 7 to 8 mm, the generalization that the circumferential speed of the profiled rolling wheel 17 is approximately twice as fast as the corresponding circumferential speed of the pencils 28 in the groove 27 is qualitatively correct.

Since the eccentricity e amounts to only a few tenths of a millimeter and the diameter $d_p$ of the profiled rolling wheel 17 is larger by several powers of 10, it is assured that the angle—not shown in the drawing—between the various tangents to the pressure face 38 on the one hand and the circumferential face 35 on the other, at which a sheath 33 touches both these faces at the same instant, is very small, by way of example 1° to 2°. Since this angle is so small it is assured that despite the narrowing of the pressure gap 41, the sheath 33 will pass, rolling, through the pressure gap 41 in the described manner and will not merely be pulled through the pressure gap 41 and simply compressed, not rotating themselves.

As a result of the described conditions, the result is achieved that the sheathes are pressed into the corresponding end of the pencil 28 and onto the eraser 34 under radially exerted pressure and with a corresponding reduction in the original diameter $d_K$ being effected. In order to reinforce this pressing process, profiled rims 44, of a triangular cross section by way of example, are disposed on the circumferential face 35. These profiled rims 44 may also be provided with knurling. What is critical is that the sheathes 33 are reduced firmly inward in their cross section both in the area overlapping the eraser 34 and in the area overlapping the pencil 28. The widened zone of the pressure gap 41 from the plane 40 to the outlet 43 serves primarily to cause the deforming pressure to be withdrawn from the sheathes steadily rather than abruptly, so as to assure that the complete pencil 28 will not be forced as it leaves the pressure gap 41. The pencil then drops into a box or the like.

In order to make it possible for the pencil 28 together with the sheath 33 tO roll off in the pressure gap 41 and thus as well to enable rotation on the part of the pencil 28 in the reception groove 27 of the transporter 4, the transporter 4 is manufactured of a material that has a low coefficient of friction with the pencils. Possible materials for the transporter 4 in the vicinity of the reception grooves 27 include polyethylene or polytetrafluorethylene, as well as highly-polished steel or brass. The reception grooves 27 are furthermore dimensioned such that when the pencil 28 moves along its course within the pressure gap 41 it is not pressed against the wall of the groove 27 but instead rests lightly against the wall.

In order to be able to adjust the pressure gap 41, for instance to adapt it to capsules of various sizes, the pressure gap is adjustable radially and also to a slight extent tangentially to the profiled rolling wheel 17. To this end, it is secured to a supporting arm 45 of the frame 1 by means of at least one fastening screw 46 and can be adjusted by means of adjusting screws 47, 48 both radially and, to a slight extent, tangentially.

The drive of the apparatus is effected from the processing machine 30, so that this processing machine 30 on the one hand and the apparatus for securing the sheathes on the other can be adapted to one another in their cycles of operation. The drive is effected by a driven shaft 49 of the processing machine 30 via a cone drive mechanism 50.

What is claimed is:

1. An apparatus for securing an eraser to a pencil by deforming a sheath mounted at one end on one end of the pencil, with the other end of the sheath partially receiving the eraser, said apparatus comprising a first means for supporting and moving a pencil along a predetermined path of movement, said apparatus additionally comprising two members positioned contiguous to each other and to said first means for receiving between said two members said sheath while said pencil is being supported and moved by said first means, said two members defining an interspace therebetween, said interspace defining a pressure gap of decreasing dimension which is larger at its inlet end and smaller toward its outlet than the outer diameter of said sheath when said sheath is in its undeformed state, at least one of said members defining said pressure gap being provided with deformation profiles, means for introducing a pencil onto said first means and for positioning a portion of the eraser-receiving end of said pencil and additionally said sheath in said interspace between said two members, and means for relatively rotating said two members whereby to impart a rolling movement to at least said sheath while said sheath is moving through said interspace.

2. An apparatus as defined by claim 1, characterized in that the dimension of said pressure gap, after a point of minimum dimension, increases again toward the outlet of the pressure gap.

3. An apparatus as defined by claim 1, characterized in that said two members are adjustable relative to one another.

4. An apparatus as defined by claim 1, characterized in that said deformation profiles are embodied as profiled rims.

5. An apparatus as defined by claim 1, characterized in that said two members rotatable relative to one another are embodied by a profiled rolling wheel and pressure chuck, and in which said pressure gap is defined between the circumferential face of said profiled rolling wheel and a pressure face, oriented toward said circumferential face, of said pressure chuck.

6. An apparatus as defined by claim 5, comprising a substantially cylindrical transporter which constitutes said means for supporting and moving a pencil along a predetermined path of movement, said transporter being provided on its circumferential face with axially holding and guiding means for the pencils.

7. An apparatus as defined in claim 6 in which said transporter is mounted for rotation on a common axis with said rolling wheel.

8. An apparatus as defined by claim 6, characterized in that said profiled rolling wheel is drivable at approximately twice the circumferential speed of said transporter.

9. An apparatus as defined by claim 5, characterized in that said pressure face of said pressure chuck has a cross section in the form of a section of a circular arc.

10. An apparatus as defined by claim 9, characterized in that the center axis of said pressure face and the axis of said profiled rolling wheel are disposed with a slight eccentricity relative to one another.

11. An apparatus as defined by claim 1, characterized in that in the vicinity remote from where the sheathes of the pencils are positioned a guide-stop is provided for fixing the axial position of the pencils.

* * * * *